United States Patent [19]

Rostomily

[11] 4,190,983

[45] Mar. 4, 1980

[54] SEVERED-TREE SUPPORT DEVICE

[76] Inventor: Clifford R. Rostomily, 4429 Brainard Rd., Orange Village, Chagrin Falls, Ohio 44022

[21] Appl. No.: 904,939

[22] Filed: May 11, 1978

[51] Int. Cl.[2] ..... A47G 7/00

[52] U.S. Cl. ..... 47/40.5; 248/523

[58] Field of Search ..... 47/39, 40.5; 248/27.8, 248/523, 524, 525, 526, 527, 528, 529

[56] References Cited

U.S. PATENT DOCUMENTS

| | | | |
|---|---|---|---|
| 1,160,698 | 11/1915 | Diederichs | 47/40.5 |
| 2,444,390 | 6/1948 | White | 248/523 |
| 2,594,187 | 4/1952 | Levitt | 248/27.8 |
| 2,899,156 | 8/1959 | Marcucci | 47/40.5 |
| 3,073,558 | 1/1963 | De Koltz | 47/40.5 |
| 3,227,405 | 1/1966 | Layton | 47/40.5 |
| 3,353,773 | 11/1967 | Budd | 248/523 |
| 3,405,896 | 10/1968 | Eby | 248/524 |
| 3,815,854 | 6/1974 | Zipser | 47/40.5 |
| 3,861,629 | 1/1975 | Merrill | 47/40.5 |

*Primary Examiner*—Edgar S. Burr
*Assistant Examiner*—James. R. Feyrer
*Attorney, Agent, or Firm*—W. W. Portz

[57] ABSTRACT

A supporting device for a severed tree or other article having a normally vertically-extending trunk comprises a platform providing upper surfaces generally within a horizontal plane on which is guidably and/or slidably supported a receptacle to which the bottom portion of the trunk may be secured and the receptacle secured in fixed position on the platform. Flexible, resiliently extendable guy members connect an upward part of the trunk to portions of the platform spaced radially outwardly beyond the range of positions in which the receptacle may be secured along the upper surface of the platform.

2 Claims, 7 Drawing Figures

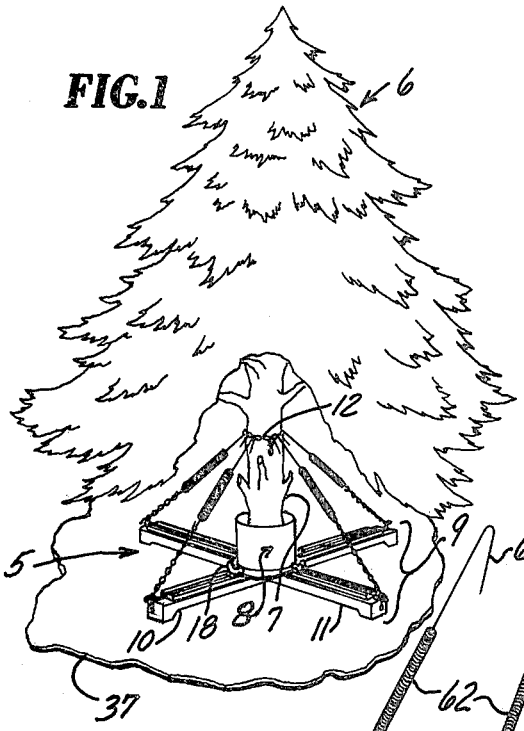
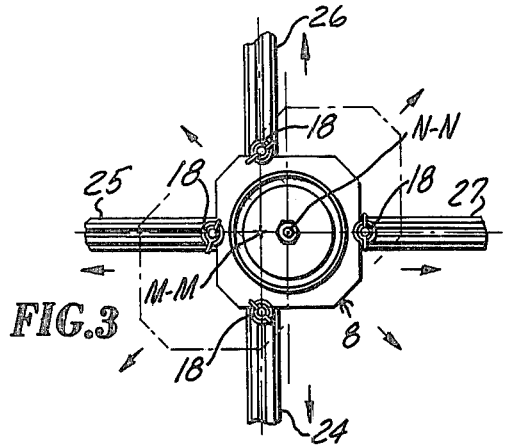
FIG.3
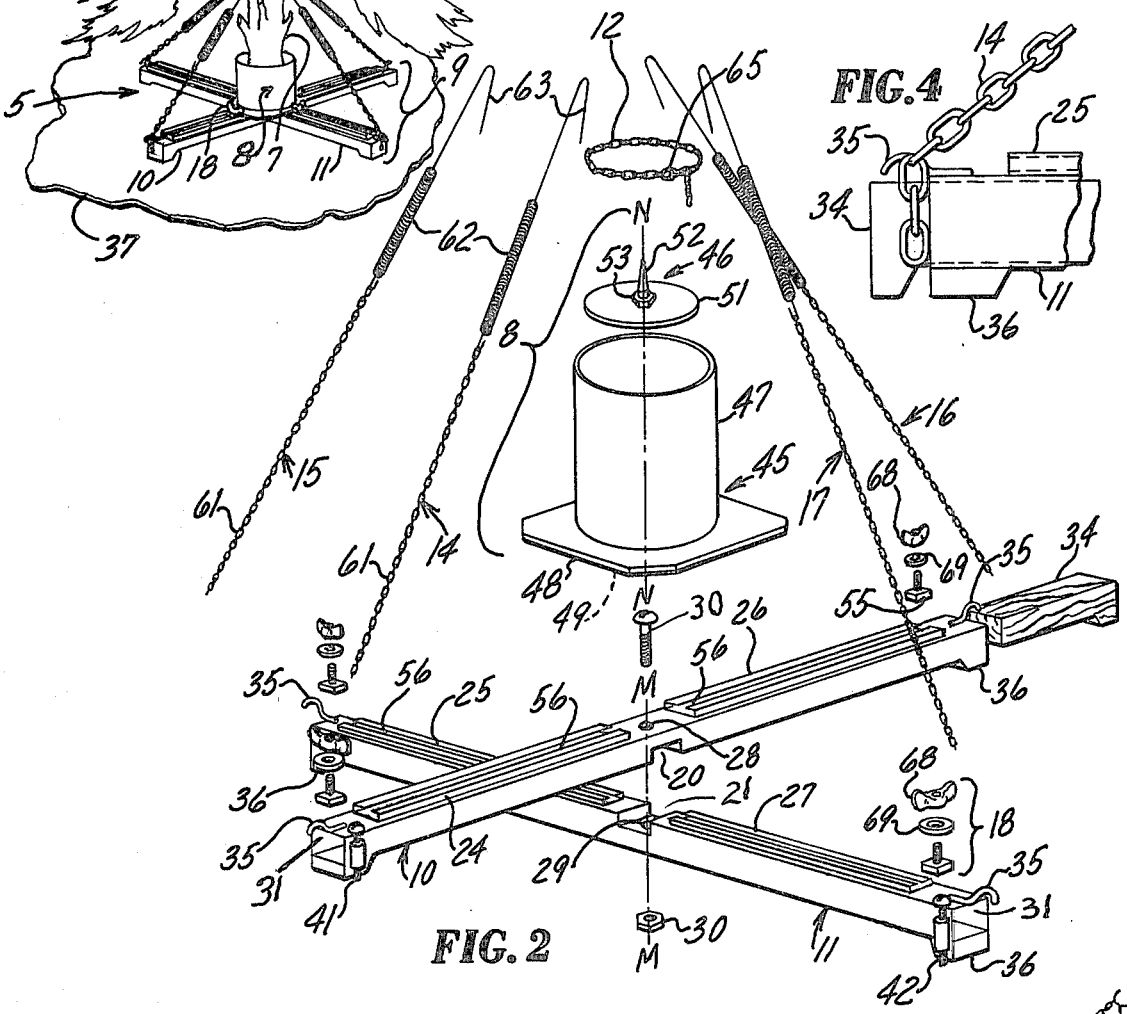
FIG. 2
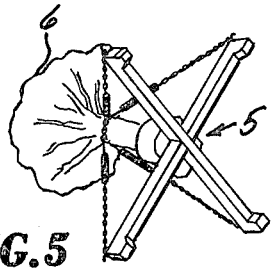
FIG.5
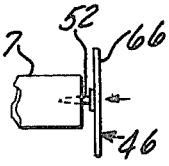
FIG.6
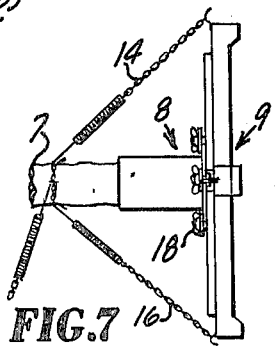
FIG.7

SEVERED-TREE SUPPORT DEVICE

BACKGROUND OF THE INVENTION

All known Christmas-tree supporting devices involve some inconvenience deemed unnecessary in the practice of this invention arising in the attaching of any of such devices to a tree and in the erection of the resulting tree and device assembly. The onerousness of this chore and the occasional hardship arising out of the jabbing and abrasion capabilities of evergreen tree needles will be much appreciated by those experienced in tree erection.

In general, such a tree-supporting device has biased guy or brace members which are difficult to adjust while holding the tree. Many devices comprise such a multiplicity of parts as to render assembly and tree erection burdensome. A common disadvantage is a lack of separability of components for compactness in storage for long periods of nonuse. Many of the prior devices are constructed, or not readily adapted for modification, for providing adjustability in establishing stable support of large trees as well as small trees.

Hence, the essential object of the invention is to render attachment of a tree-support to a tree and the erection of the resulting assembly more convenient and with greater comfort than is now possible. Other objects are to provide a tree support of sufficiently simple, inexpensive design as to be readily marketable while providing such features as liquid application to the tree butt, adjustability for stabilizing the support of trees of different sizes, improved accessibility for the adjustment of components with the tree in place, and no need for stripping branches from the butt of the tree to attach the support device.

SUMMARY OF THE INVENTION

In accomplishing the above and any other objects, the present invention resides in a device for supporting a severed tree or other article comprising a normally vertically-extending trunk wherein the principal feature is a tree-butt receptacle which is adjustable and fixedly securable in any desired position along the upper surface of a platform portion of the device contemporaneously with the application of forces to the trunk by a plurality of longitudinally-resilient guy members connecting between radially-outward portions of the platform and an upper portion of the trunk.

Accordingly, the device comprises a tree-butt receptacle; a platform having bottom areas for engaging a floor or other base, and upper surfaces arranged with respect to the under surface of the receptacle to support the receptacle in a range of positions along a horizontal plane; fastening means, such as clamp-bolts anchoring in both the platform and the receptacle for securing the receptacle to the platform in desired positions of the above-indicated range; and guy means, such as a multiplicity of tandem tension spring and chain assemblies oriented with the chain portion downward.

In preferred embodiments, the platform comprises a pair of sills secured to each other in crossed separable interlocking relationship and having longitudinal guideways along upward-facing surfaces thereof for receiving lower portions of the above mentioned clamp bolts. Moreover, the receptacle may comprise a liquid-retaining vertical wall surrounding a tree-butt receiving region and further comprise radially extending peripheral edge portions horizontally overlapped by upper portions of the clamp bolts.

DESCRIPTION OF THE DRAWING

FIG. 1 is a perspective view of a severed tree and the tree-support device of the invention in attachment thereto with lower branches of the tree cut away to better illustrate the device.

FIG. 2 is a perspective exploded view of the support device of FIG. 1.

FIG. 3 is a fragmentary plan view of the device of FIGS. 1 and 2 illustrating changes of position of a tree-butt receptacle relative to crossed supporting sills therefor.

FIG. 4 is a fragmentary side view illustrating a portion of a sill of the device as connected with the chain portion of a guy assembly.

FIG. 5 is a fragmentary perspective view of a tree and support device in a final stage of assembly permitted by a prone position of the tree.

FIG. 6 is a fragmentary side view illustrating application of a plate and spike member of the tree-butt receptacle to a tree.

FIG. 7 is a fragmentary side view of a tree and the support device illustrating an intermediate stage of attaching the device to the tree.

DESCRIPTION OF A PREFERRED EMBODIMENT

FIG. 1 illustrates a preferred design of a tree-supporting device 5 in the performance of its intended function in accordance with this invention, i.e., erect support of a tree 6 having a trunk 7 in generally vertical alignment as achieved in the relative adjustment of platform and receptacle positions. The device 5 comprises as major components, a tree-butt receiving receptacle 8; a platform 9 comprising cross sills 10 and 11; a trunk-encircling bracelet member 12 shown in the form of a chain; guy means comprising tandem spring and chain assemblies 14, 15, 16, 17; and means for fastening the receptacle 8 to the platform 9 shown in the form of clamp bolts 18.

The Platform

The platform 8 may be constructed in any form which will permit adjustment of the receptacle thereover in a horizontal plane and the securement thereto by fastening means connected with both the platform and the receptacle but, in a preferred design, the adjustment of the receptacle relative to the platform is efficiently achieved with good supporting function and rigidity of the device as a whole by sills 10, 11 crossed to provide four arms progressively angularly-spaced at 90° apart with respect to the platform axis M—M. The sills 10 and 11 have notches 20, 21, respectively, located midway along their lengths and of the proper vertical depth as to enable one sill at its notched portion to be received in the notch of the other cause their upper surfaces, especially those of respective guideways 24, 25, 26, 27 to extend within a single plane complimentary to the undersurface 49 of the receptacle 8 as shown. To enable a rigid interlock of the sills 10, 11, the notched portions have vertically extending apertures 28, 29 normally occupied by a tightened nut and bolt assembly 30. The sills 10, 11 may be made identical except for the notches 20, 21.

Another feature of the invention is directed to the non-tipping capability of the device for supporting relatively large trees as well as small trees without bulky permanent platform construction. As one mode of rendering the platform radially extendable for large trees, the sills 10, 11 of the presently described embodiment are substantially hollow to define open regions 31 in all radial arms of the sills bounded by internal rectilinear surfaces complimentary to external surfaces of sill extensions as typified by extension 34. FIG. 4 shows one of the extensions 34 in radially inserted position within the sill 11 corresponding to small tree use or storage of the device. FIG. 2 shows a sill extension 34 completely withdrawn from the sill 10 and its adaptability for separate packaging. The sills further comprise connecting means, such as hooks 35, fixed to respective platform arms at the upper radial extremities thereof for connecting the sills with guy members 14, 15, 16, 17. The sills are further constructed with pads 36 to provide bottom areas located in angularly spaced and radially spaced relation with respect to the platform axis M—M by which the device 5 rests on a floor 37.

While a three-arm platform automatically seats on any irregular floor surface, a four-arm platform is described above as a preferred embodiment because of its convenience of adjustment and its more stable and secure tree-supporting capabilities. To overcome any failure of the four-arm platform to adapt to a floor surface, anti-rocking set screws 41, 42 in threaded relation with sills 10, 11, respectively, may be provided in lieu of a simple wedge insertable under one of the pads 36. Various shapes and modifications of a platform in lieu of platform 8 are possible within the basic concept of this invention.

The Receptacle

The receptacle 8 is shown herein as a two-piece assembly comprising a liquid container 45 and a plate member 46. The container 45 is formed of a cylindrical wall 47 open at the top and a bottom wall 48 which functions as a bottom closure of the side wall. The plate member 46 consists of a plate 51 having an undersurface 66 and spike or pin 52. The pin 52 is conveniently formed of a bevel-headed bolt extending through a central countersunk aperture of the plate and tightly secured at the upper end with sharpened, upwardly protruding, end positioned for impaling the bottom surface of the butt of the tree 6. The nut 53 provides a diametrically enlarged shoulder surface on which the tree settles. Being thus supported above upper surface of the plate 51, the tree is free to lean in any direction relative to the axis N—N during attachment of the device 5 to the tree and during subsequent adjustments of the chain-and-spring guy members to bring the trunk of the erected tree into a desired vertical alignment.

The bottom wall 48 is extended outwardly from the side wall 47 to provide radially protruding edge portions and sufficient undersurface of wall 48 to establish stable support of the receptacle on the four guideways 24, 25, 26, 27 of the platform. Moreover, the edge portions of wall 48 are required for receiving upper portions of the clamp bolts 18 in overlapping relation with upper surfaces areas of the edge portions.

Clamp Bolts

The bolts 18 have lower portion means, such as the square heads 55 shown, which are insertable into the ends of the slots 56 of inverted tee-shape defined by the guideways 24, 25, 26, 27. The upper portions of the bolts comprise nuts 68 and washers 69. When tightened against the upper edge surfaces of wall 48, the receptacle is secured against lateral as well as vertical movement relative to the support 9.

Guy Members

The guy members 14, 15, 16, 17 may be identical and comprise, as shown, chains 61 as the lower portions thereof, and springs 62 as upper portions connected in tandem with the chains and terminating upwardly as hooks 63.

Bracelet Member

The member 12 is required to be flexible and adjustable to trunk circumferences varying in length. Preferably, the member 12 comprises, as shown, a chain terminating in snap connection 65.

Erecting the Tree

While tree-erection procedure need not follow an exact pattern, a method of tree erection is suggested as follows. Lay the tree in a prone position suggested by FIGS. 5 and 7. Install the bracelet member 12 on a portion of the tree trunk, e.g., one and a half or two feet upward from its butt end. Attach the hooks 63 of the guy members to portions of the bracelet member 90° apart. Jam the plate member against the butt end of the trunk 7 as shown in FIG. 6 to cause the pin 52 to penetrate the end surface of the trunk. With the liquid container 45 of the receptacle temporarily joined by bolts 18 to the support 8, slide the receptacle container 45 over the applied plate member 46 to attain the relative positions of FIG. 1 and FIG. 7. Attach the lower ends of guy members 14, 15, 16, and 17 to hooks 35 so as to subject all springs 62 to substantial tension. It is preferable to first attach members which are 180° apart. Orient the assembled tree and support device 5 from the prone position of FIG. 5 to the upright position of FIG. 1. Then loosen the clamp bolts 18, and shift the receptacle 8 to a position on the platform 9 bringing about a desired vertical position of the tree. Thereupon reposition the clamp bolts along respective slots 56 until the edges of plate 48 are overlapped by the wing nuts 68 and 69. Tighten the wing nuts to secure the receptacle to final position. FIG. 3 illustrates in dotted outline a few of the many positions to which the receptacle 8 may be shifted relative to the platform 9 with resulting horizontal spacing of the axes M—M and N—N to attain alignment adjustment of the trunk 7.

What is claimed is:

1. A device for supporting a severed tree or other article having a normally vertically extending trunk aligned along a first normally vertical axis of the device comprising:

a platform having a second normally vertical axis and comprising a pair of sills in crossed separable interlocking relationship, said sills being notched at respective crossed portions intersected by said second axis to provide an interlock, fastening means extending axially through said crossed portions to secure and fix said sills in said interlock, each of said sills defining guide means along upper surfaces thereof, at opposite sides of the second axis providing longitudinal slots of inverted T-shaped cross section;

receptacle means approximately centered in said first axis and comprising a top-opening liquid container having a cylindrical side wall and a bottom wall extending radially outwardly from the side wall to define a horizontally-protruding edge portion; and a separable plate member adapted to be inserted into said container onto the bottom wall in loose conformity with the inner surface of the sidewall, said plate member having an upstanding pin for insertion into a tree trunk;

releasable fastening means comprising four nut and bolt assemblies of which end portions comprise a bolt head at one end and a nut at the other end enabling one of said end portions to be received in said T-shaped slot and the other to overlap said bottom-wall edge portion;

elongate resiliently-extendable guy means having lower portions connecting with radially outward portions of all of said sills; and connecting means for attaching the upper portions of said guy means to a portion of a tree trunk spaced upwardly from said receptacle means.

2. The device of claim 1 wherein:

said connecting means comprises a flexible bracelet member constructed and adapted for encircling a portion of a tree trunk spaced upwardly from said receptacle means;

each of said radially-outward sill portions is provided with hook means; and each of said guy means is a tandem assembly connecting with said bracelet member and comprising an upward tension spring and a length of chain at the lower end of the assembly enabling adjustable connection of each guy means with a hook means.

* * * * *